United States Patent [19]

Nichols

[11] 4,397,466

[45] Aug. 9, 1983

[54] DISK PUZZLE

[76] Inventor: Frank Nichols, 3250 N. Hall, Dallas, Tex. 75204

[21] Appl. No.: 301,831

[22] Filed: Sep. 14, 1981

[51] Int. Cl.[3] ..... A63F 9/12

[52] U.S. Cl. ..... 273/156; 273/160

[58] Field of Search ..... 273/156, 157 R, 160; 70/289, 298; 206/1.5

[56] References Cited

U.S. PATENT DOCUMENTS

| | | | |
|---|---|---|---|
| 580,542 | 4/1897 | Battey | 273/156 |
| 803,059 | 10/1905 | Hill | 273/160 |
| 2,009,905 | 7/1935 | Rankin | 206/1.5 |
| 2,181,116 | 11/1939 | Boyle | 273/156 |

FOREIGN PATENT DOCUMENTS

| | | | |
|---|---|---|---|
| 604792 | 9/1978 | Switzerland | 273/160 |
| 2064965 | 6/1981 | United Kingdom | 273/153 S |

OTHER PUBLICATIONS

"Creative Puzzles of the World", by Van Delft & Botermans, published by Harry N. Abrams, ©1978, p. 70.

*Primary Examiner*—Anton O. Oechsle
*Attorney, Agent, or Firm*—David O'Reilly

[57] ABSTRACT

A manipulative disk puzzle comprised of three identically shaped pieces which interfit to form a geometric solid which appears to have the form of a plurality of stacked disks. Each piece has a plurality of disk tri-sections which are integrally fastened to one another and offset from each other approximately 60 degrees. The pieces are also provided with a plurality of holes in which manipulative pegs are inserted having a depth equal to two layers. Thus, when the pegs are between two separable surfaces the interfitted pieces are locked together.

34 Claims, 21 Drawing Figures

DISK PUZZLE

BACKGROUND

This invention relates to puzzles generally and more particularly relates to a manipulative disk type puzzle.

A disk type puzzle called the "Magic Disk" is shown and described in a book entitled "Creative Puzzles of the World" by Peter Van Delft and Jack Bartermans 1978, page 70 (Harry N. Abrams Inc., Publishers). This puzzle is in the form of three identical wooden disks which have been tri-sected and the sections glued together in a special pattern. The disks may then be fitted together to form a geometric solid which has the appearance of three stacked disks. With the three disks assembled, they cannot be pulled apart by any amount of pulling or tugging. Only a force applied in a certain way can separate the three components forming the stacked disks.

In order to separate the disks a shaft or pin may be placed in a hole in the center of the assembled disks and the disks spun with great force. The centrifugal force will cause the three components of the magic disk to separate and the components may then be completely separated by gently pulling them apart. Reassembling them is quite difficult, however, and requires a great deal of dexterity. The respective corners of the three parts have to be matched with the center of the hole in the other components and the disks carefully pushed together. Alternatively, the three disks may be separated by gently pushing alternate corners of the three components which will apply a force equivalent to the centrifugal force described above. A disadvantage of this puzzle is that once the method of separating them has been learned, the challenge has been removed as no variations are possible.

Another version of the puzzle was designed by Professor, Lionel Penrose, and is sold by Pentangle Hampshire, England and is called "Pandora's Box". This version of the puzzle has a poker chip inside that says "Hope!" on it. This piece apparently serves as a reward for opening the puzzle, but it is also there to make the person working the puzzle believe that it is the only internal element. The fact is, there is a small metal dowel which locks the layers of the puzzle together so that nothing can be moved. The only way to open the puzzle is by holding the puzzle vertically and shaking it so that the pin can be positioned in the center layer. Solving this puzzle is more by luck than by skill on the part of the problem solver. Once completely disassembled, this puzzle is even more difficult to put back together.

SUMMARY

The purpose of the present invention is to provide a manipulative disk puzzle which provides a variety of challenges to the puzzle solver.

The principal motion used to disassemble or solve the puzzle of the present invention is similar to the prior art described above, but there are notable unique differences which make the puzzle a challenge and improve the assembly and disassembly. First the corners of the present disk puzzle were all rounded. This is done so that the puzzle could be reassembled more easily, and make them less of a health hazard. Both examples in the prior art have very sharp corners which is part of the reason why they are so difficult to reassemble.

In addition, the present invention is preferably provided with four layers instead of three as in the prior art. The seams on layers one and three as well as layers two and four align. This makes the puzzle appear more sophisticated.

A very unique feature of the present invention and which makes the puzzle have a great number of variations is the addition of variable positioned or sized inserts in the form of pegs which make it more interesting to solve because a specific combination has to be determined before any of the three pieces may be moved. The variable pegs are positioned in six holes, formed by alignment of respective holes in the three components. More holes could be provided if desired to increase the variety and difficulty, if desired. The inserts are a length approximately equivalent to the depth of two of the levels so that the pegs can be positioned between two integral layers allowing movable surfaces to be separated. The six holes allow for several variations which will solve the puzzle, but many times more which will prevent the components from being separated. Thus, the present invention provides a constant challenge to the user as he can easily see and position the inserts, but because of the symmetry and the identicality of the three components, cannot easily memorize all the particular positions.

Preferably the disk puzzle is molded out of plastic which makes it less likely to warp from moisture as would be the case with the wooden puzzles previously described. Also, the use of the same color plastic for all three identical components makes the puzzle more sophisticated because it will be difficult to tell the components apart.

It is one object of the present invention to provide a manipulative disk puzzle which has a variety of solutions.

It is another object of the present invention to provide a manipulative disk puzzle of improved construction, having rounded corners to make assembling easier.

Still another object of the present invention is to provide a manipulative disk puzzle of three substantially identical pieces having variably positioned inserts which provide a variety of solutions for the puzzle solver.

Yet another object of the present invention is to provide a manipulative disk puzzle comprised of three identical interfitted pieces having disguised interfitting surfaces.

Other objects, advantages and novel features of the invention will become apparent from the following detailed description of the invention when considered in conjunction with accompanying drawings wherein like reference numbers identify like parts throughout.

DESCRIPTION OF THE PREFERRED EMBODIMENT

The manipulative disk puzzle of the present invention is shown in its assembled form in FIGS. 1 through 5. The puzzle has the appearance of four separate layers or levels 10, 12, 14 and 16, each comprised of a tri-sected disk having diamond shaped sections 18, 24 and 30. In actuality one component piece of the puzzle is comprised of four integrally joined diamonds such as 18, 19, 20 and 21 (see FIG. 7) which are offset from each other by sixty degrees. Thus, the seams 32 and 34 are actually false or disguised seams as the respective diamond shapes are integrally attached. (For purposes of illustration only, the true seams are indicated as double line and the false seams indicated as single lines). In the actual molded plastic puzzle, the true seams and false seams cannot be distinguished. This makes it difficult to determine where the components are interleafed or interfitted.

Figure 1:
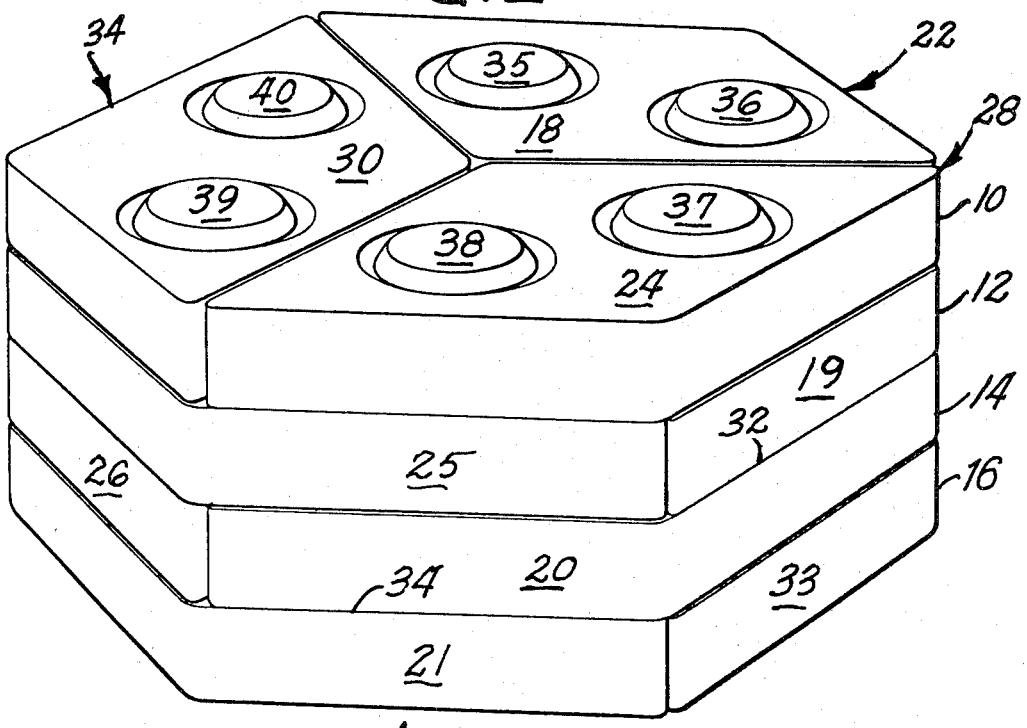
FIG. 1 is a perspective view of the puzzle in its assembled form.
Figure 2:
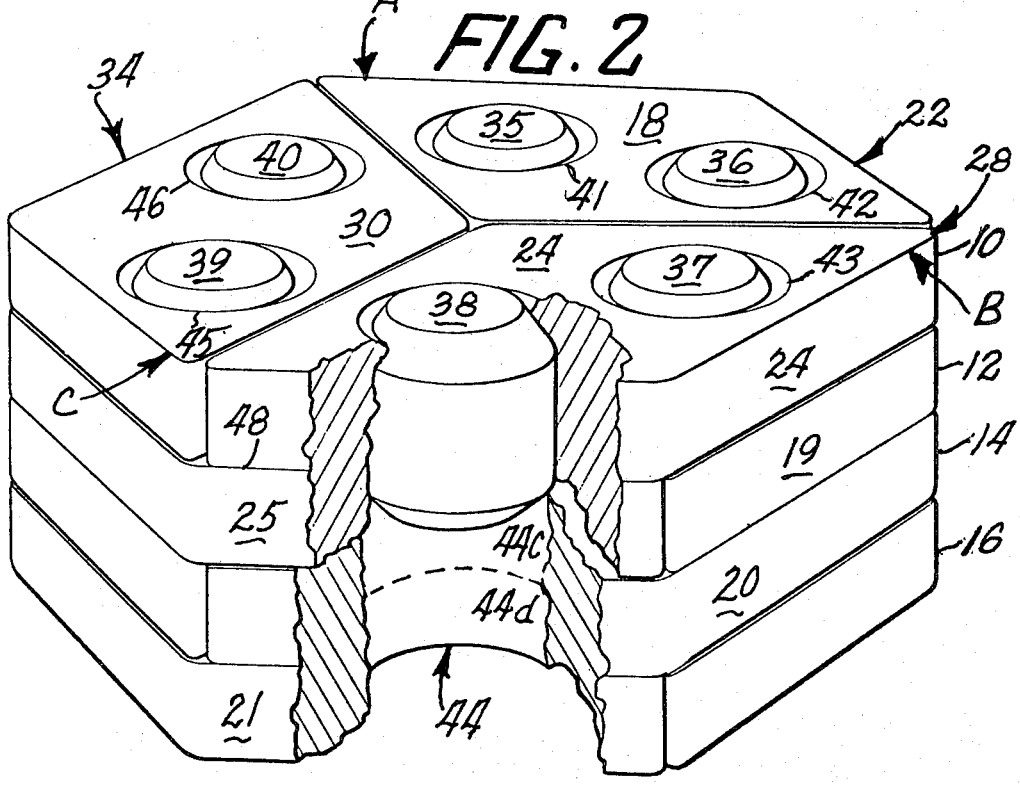
FIG. 2 is a view of the disk puzzle partially sectioned to illustrate the operation of the variable positioned inserts.
Figure 5:
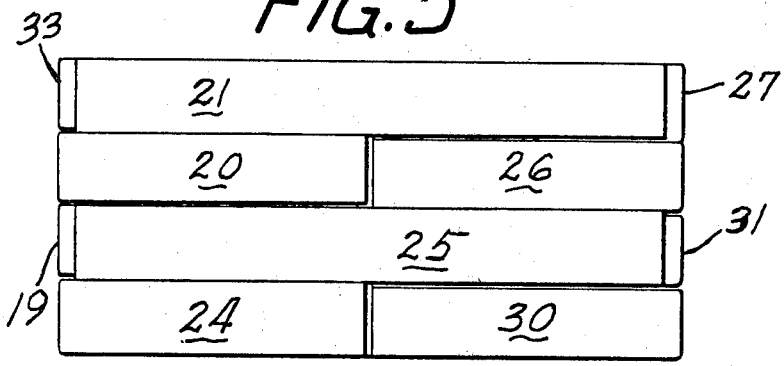
FIGS. 4 and 5 are side views respectively of the disk shown in FIG. 3.
Figure 3:
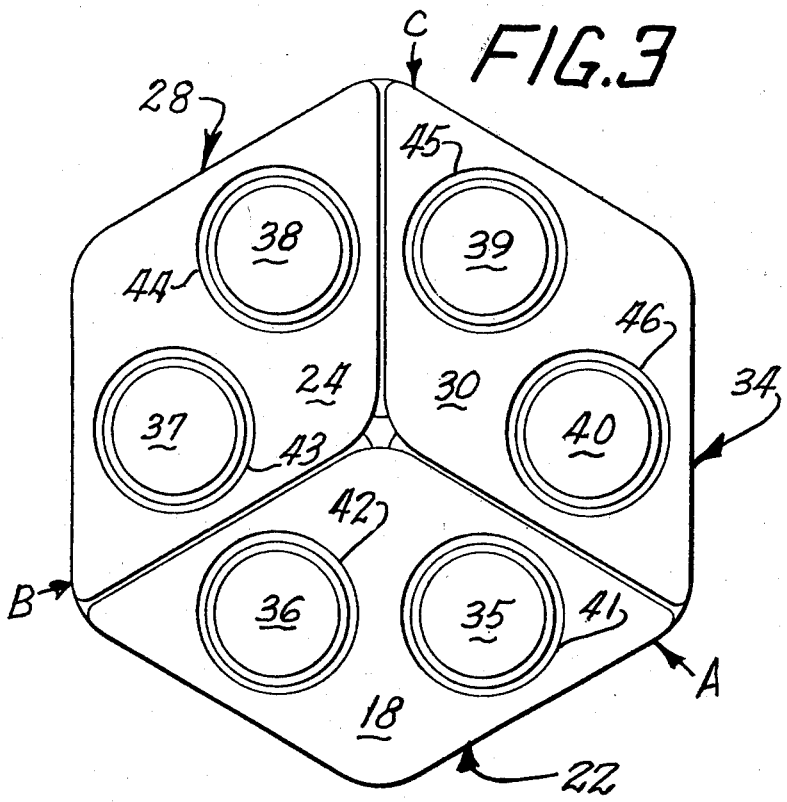
FIG. 3 is a top view of the disk puzzle.
Figure 4:
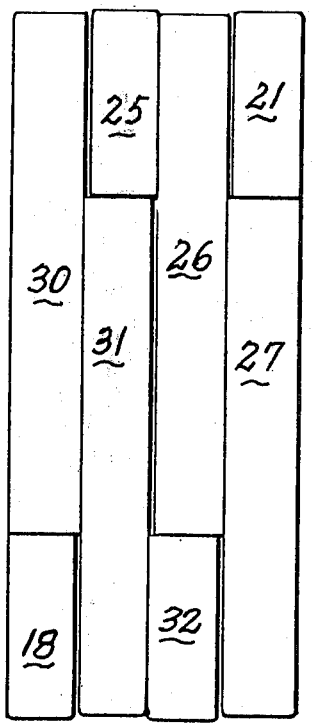

Thus the puzzle is comprised of three pieces 22, 28 and 34, each consisting of four partially overlapping integrally connected diamond shaped pieces which when fitted together form the hexagonal shape shown. Without the variably positioned inserts or pegs 35 through 40, the puzzle may be opened by applying a force at alternate corners indicated at A, B and C as shown in FIG. 2. Applying force simultaneously at these three points is equivalent to the centrifugal force described or discussed about with respect to the "Magic Disk". Applying force simultaneously on any other than these three corners will tend to force one or more of the pieces together preventing the puzzle from separating.

In order to increase the variations and make the puzzle more interesting and challenging, the variably positioned inserts 35 through 40 are provided. These variable positioned inserts fit in sockets or holes 41 through 46 which pass completely through the assembled disks as can be seen more clearly in the partial section of FIG. 2. The variable insert 38 shown in this view can be manipulated in the hole 44 by pushing on the top to slide the insert to any position desired. If the insert 38 is between two interleafed surfaces, they obviously cannot separate. Only when the insert is in the position shown between two integrally formed surfaces indicated by the false seam 48 can the pieces 22, 28 and 34 be separated.

The number of variations and therefore the challenge, is further increased by providing six such inserts. Thus, each one of the inserts must be properly positioned before the components can be separated. Adding to the challenge is the fact that since there is more than one integral surface between respective diamonds, there are a number of solutions. That is, the inserts 35 to 40 can be in a variety of positions as long as they all are in a respective hole between two integrally formed surfaces rather than two separable surfaces. When, by proper manipulation this is achieved, the three components 22, 28 and 34 can be separated as described above by simultaneously applying force at the three alternate corners A, B and C.

Figure 6:
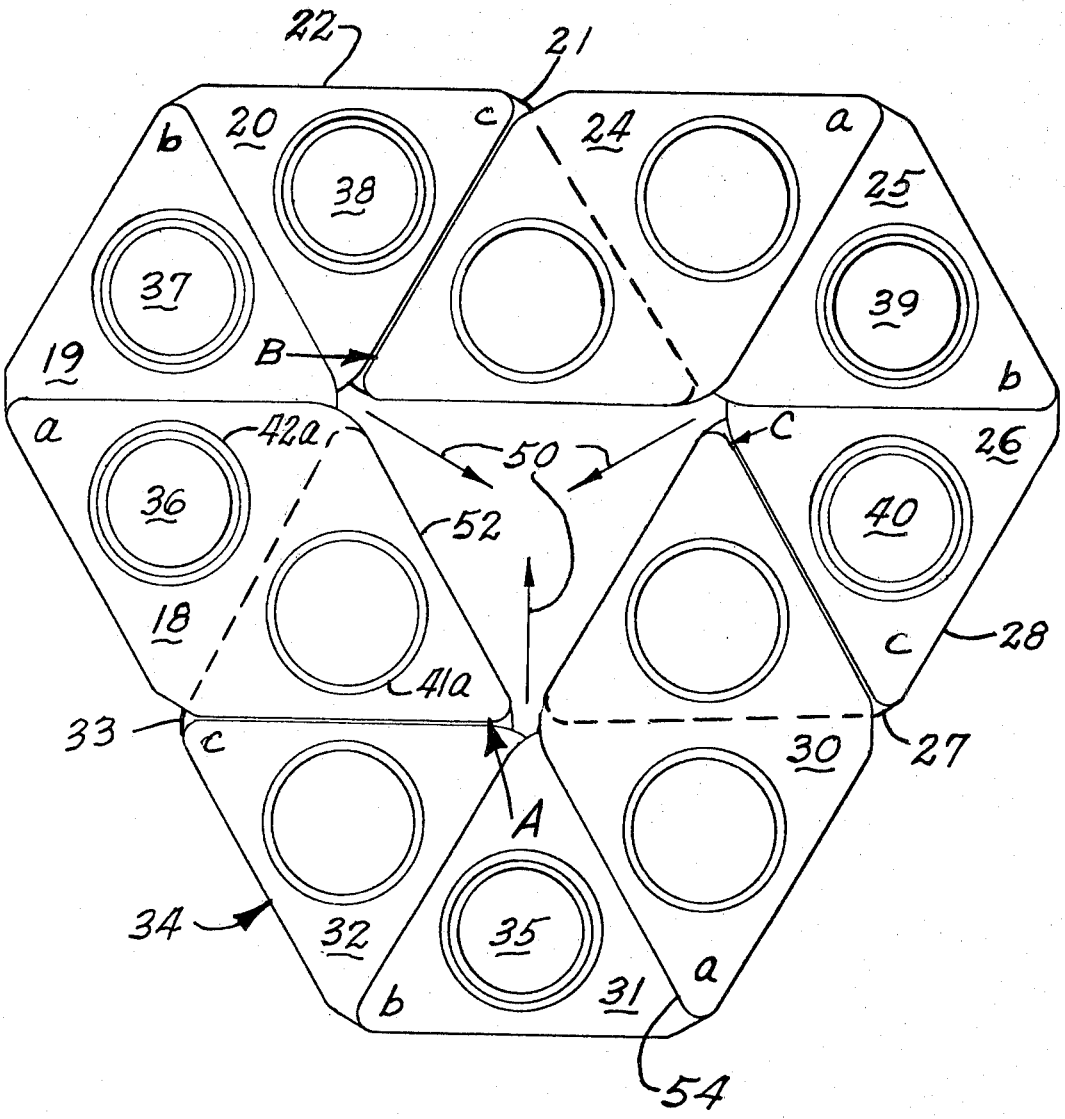
FIG 6 is a top view showing the disk puzzle separated.

This is illustrated in FIG. 6 where the manipulative disk puzzle is in its maximum separated position (i.e. just before the individual pieces can be taken apart). Component 22 is shown formed of diamond shaped pieces 18, 19, 20 and 21, and components 28 and 34 formed of pieces 24 to 27 and 30 through 33 respectively. The force for separating the pieces is again indicated at points A on piece 18, B on piece 24, and C on piece 30.

To reassemble the disk puzzle, the pieces are placed in the position shown and just pushed together as indicated by the arrows in the triangle at 50. Thus, the inner edge 52 of piece 18 will slide against the mate with the edge 54 of diamond shape piece 30. Simultaneously, 30 will mate with 24 and 24 will mate with 18, returning to the assembled position shown in FIG. 1. Note also the position of the variably positioned inserts 35 through 40. Only one peg, 35 is in the component 34 while three pegs are in component 22 and two in component 28. This illustrates one of the solutions to positioning the variably positioned inserts to solve the puzzle.

Figure 9:
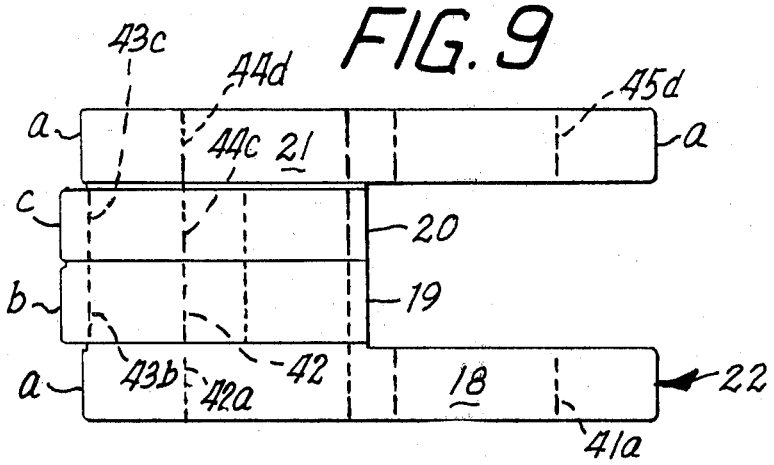
FIGS. 8 and 9 are side views respectively of the components shown in FIG. 7.
Figure 7:
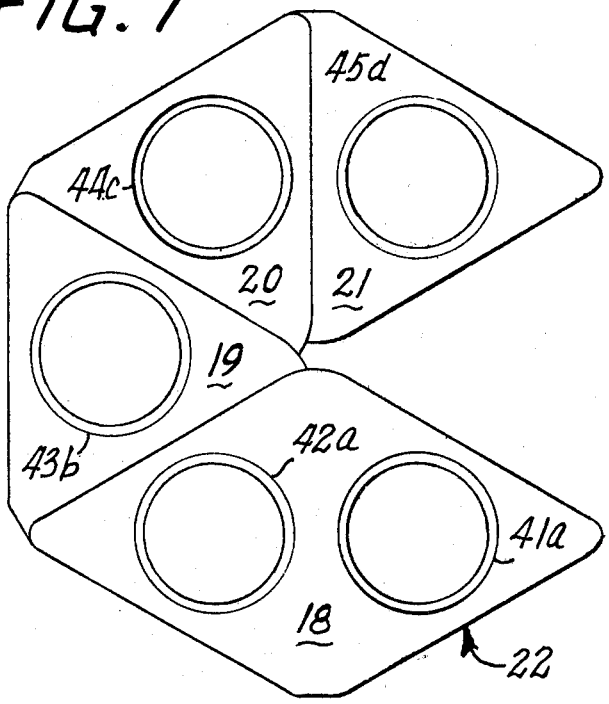
FIG. 7 is a top view of one of the components of the disk puzzle.
Figure 8:
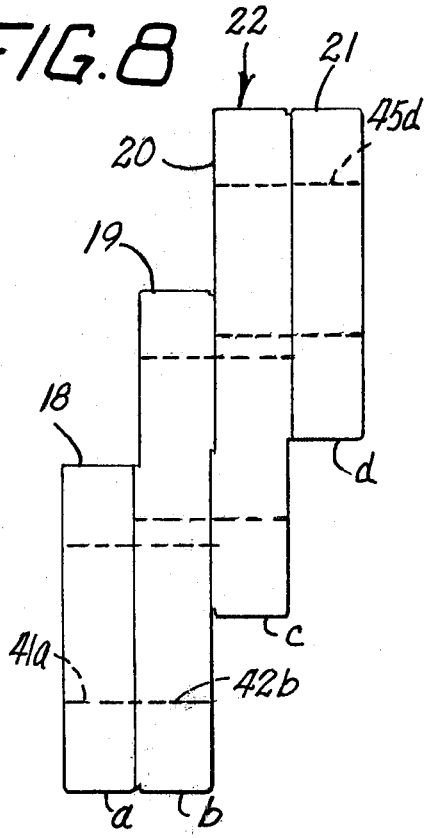

As can be seen by the illustrations in FIGS. 7 through 9 of one of the components, each component has five holes labeled in FIG. 7 **41*a* through 45*d*. The designation "a" through "d" indicate the four levels of the component with "a" indicating the uppermost or top of the component. Thus, as can be seen, hole 44 passes through levels a and b of component 28 and levels c and d of component 22. That is, with the components assembled as shown in FIG. 2 hole 44 passes through level c and d of diamonds 20 and 21 as also can be seen in FIG. 9. Thus, when the variably positioned insert 38 is either within the diamonds 24 and 25 of component 28 or within the diamonds 20 and 21 representing the hole 44*c* and 44*d* of component 22, the insert is properly positioned for opening or solving the puzzle. Likewise, the hole 41 will be comprised of the hole 41*a* in diamond 18 of component 22, 41*b* and 41*c* in diamonds 31 and 32 of component 34 and 41*d* in diamond 27 of component 28 (not visible in FIG. 6). Of the three components, level d in FIG. 6** is shown as a dotted line because it is not visible in this view.

Figure 10:
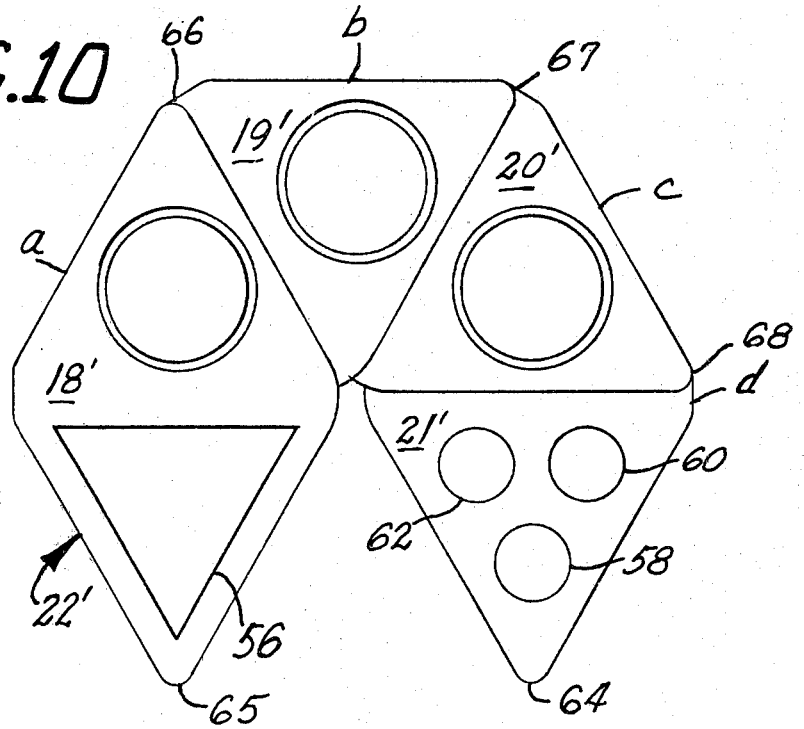
FIG. 10 illustrates one variation of the disk puzzle.
Figure 11:
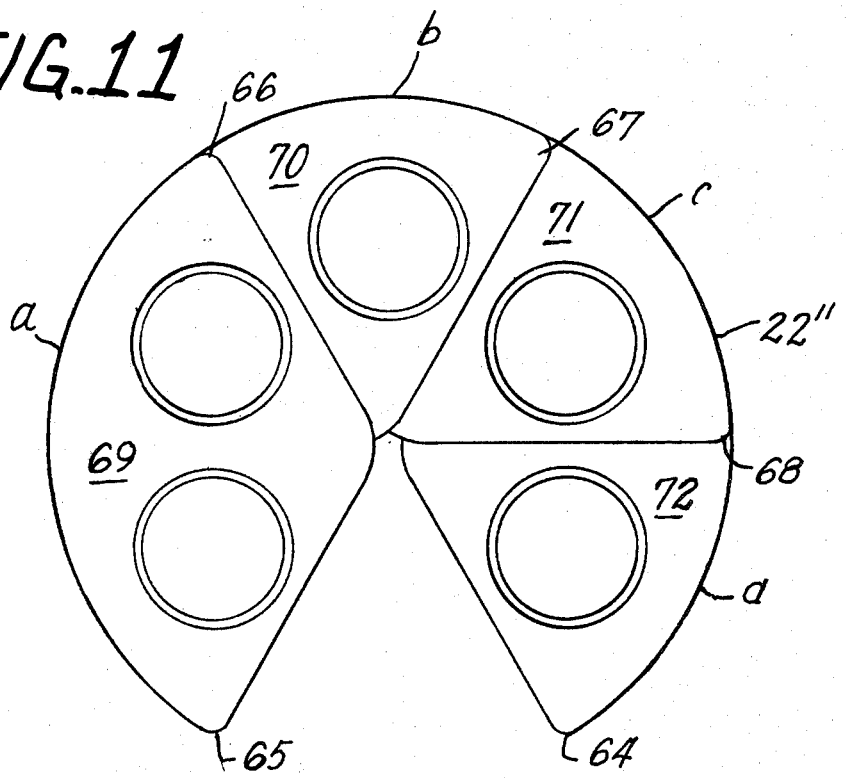
FIG. 11 illustrates another variation of the disk puzzle.

While the preferred embodiment provides six through holes for six variable inserts, the number of through holes as well as the shape of the holes, could vary as illustrated in FIG. 10. Additionally, the outside or peripheral shape of the pieces illustrated could also be varied to provide a shape other than the hexagon shown in FIGS. 1 through 9. For example, as shown in FIG. 10, the holes could be triangular shaped as shown at 56 with an appropriate triangular insert provided. Further, there could be three holes as shown at 58, 60 and 62 in FIG. 10, as well as other shapes, if desired. In FIG. 11, a component 22″ having a circular outside peripheral shape is shown. In all embodiments, the corners shown at 64, 66 etc. would all be rounded to allow smooth operation in manipulating the puzzle as well as for safety reasons. The embodiment shown in FIG. 11 would be comprised of four trisections 69 through 72 having two straight sides and one partially circular side.

Thus, the pieces when fitted together form a circular peripheral shape.

Figure 12:
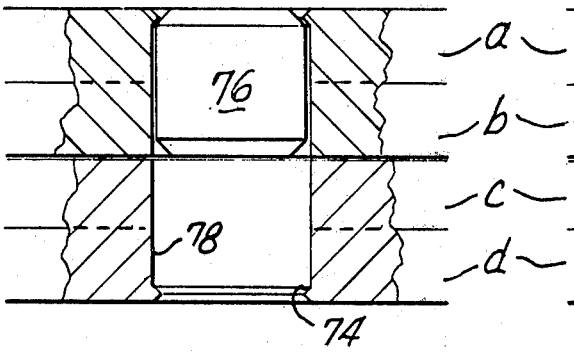
FIGS. 12 through 15 illustrate the manipulation of the variable inserts.
Figure 13:
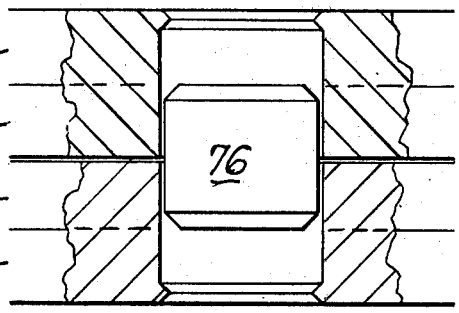

The manipulation of the inserts 35 through 39 is illustrated in FIGS. 12 through 15. Preferably, the sockets or holes and the respective components would have chamferred edges illustrated at 74 to retain the insert 26 in the socket 78. As illustrated in FIGS. 12 and 13, the integral levels are a, b and c, d. Thus, the insert 76 when it is in a position as shown in FIG. 12 will permit the puzzle to open. However, if the peg is manipulated to be in the position as shown in FIG. 13, the puzzle will be locked preventing separation.

Figure 14:
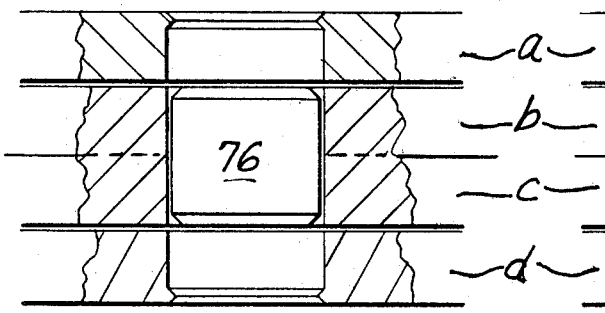
Figure 15:
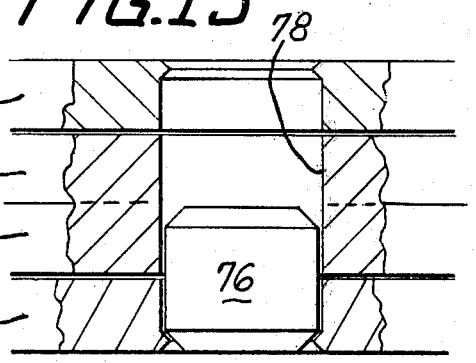
Figure 16:
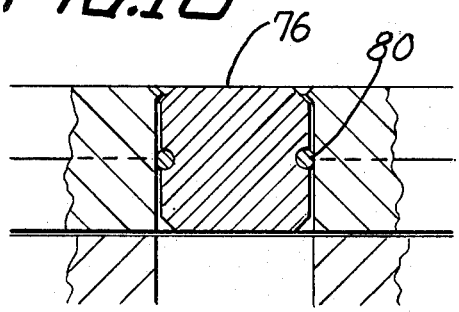
FIG. 16 illustrates a variation in the construction of the variable inserts.
Figure 17:
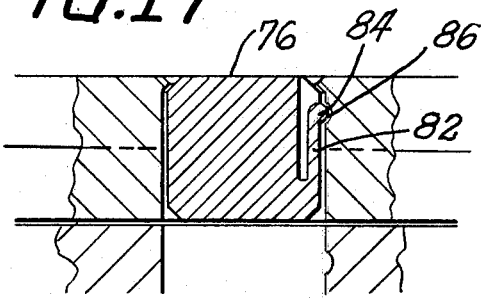
FIG. 17 illustrates another variation in the construction of the variable inserts.

The illustrations in FIGS. 14 and 15 show the position when the integral surfaces are between levels b and c. Thus, manipulation of the peg 76 to the position shown in FIG. 14 will allow the two surfaces to separate. When the insert is manipulated to the position shown in FIG. 15 at the end of the socket 78, the components formed having the levels b, c and d will be locked together.

In order to secure the insert 76 in the hole and provide a snug fit, an O-ring as shown at 80 may be provided. This will also serve to frictionally retain the inserts in the holes. Alternately, a flexible leaf 82 having a ball 84 which fits a socket 86 in the hole could be provided to achieve positive locking of the peg 76 at various levels. These variations are merely to suggest possible ways in which the variable positioned inserts might be secured in the sockets.

In order to make the puzzle increasingly interesting and more challenging, a suggested modification to the variably positoned inserts is inserted in FIGS. 18 through 21. The insert 88 may be comprised of a sleeve 90 having a slidable plug 92. An annular shoulder 94 on the interior of the sleeve 90 would fit the annular groove 96 in the insert 92, acting as a stop. This will permit the plug to slide within the sleeve 90 until it reaches the stop, then the two pieces would slide together.

Figure 18:
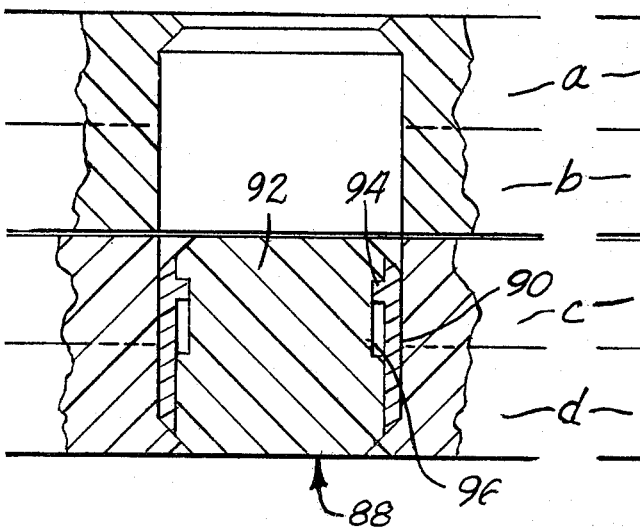
FIGS. 18 through 21 show an alternate construction of the variable positioned inserts as a telescoping variable insert.
Figure 19:
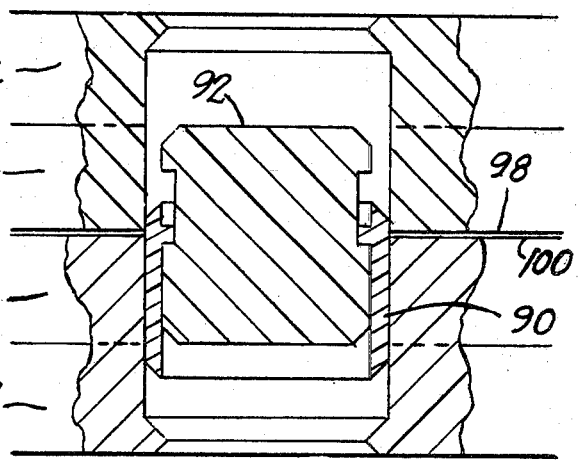
Figure 20:
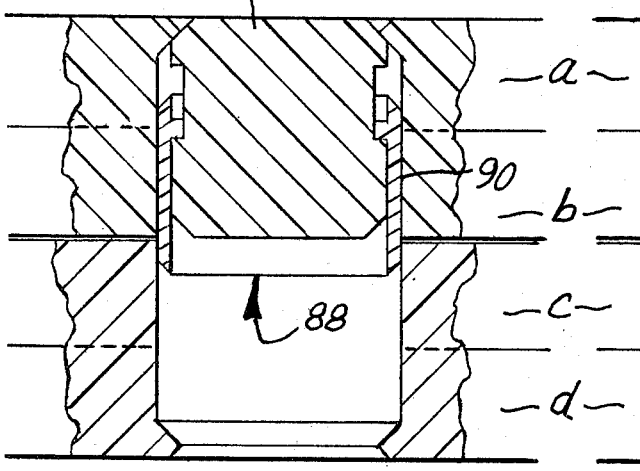
Figure 21:
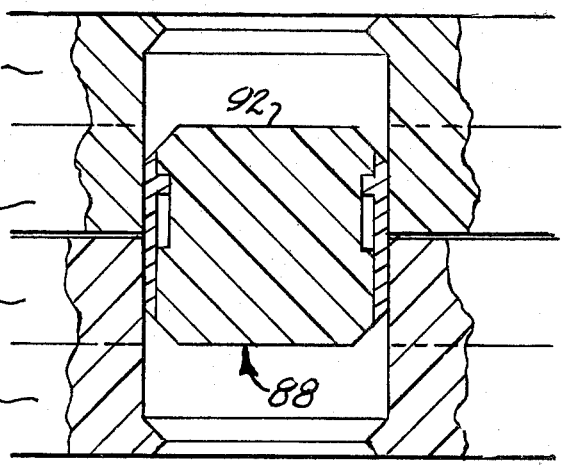

With the insert construction illustrated in FIGS. 18 through 21, the number of variations and consequently the degree of difficulty in solving the puzzle will be substantially increased. For example, with the sleeve and plug positioned as shown in FIG. 19 between the separate surfaces 98 and 100, the puzzle will be locked. If the insert 88 is manipulated as illustrated in FIG. 20, the sleeve 90 will still prevent the separation of the surfaces 98 and 100 keeping the puzzle locked. The sleeve 90 must also be pushed upward or the entire insert 88 pushed completely down as shown in FIG. 18 in order to allow the separation of the surfaces 98 and 100 and unlock the puzzle. As shown in FIG. 21, the insert 88 acts as a single insert as in the previous embodiments locking the puzzle. This is a unique and novel alternative for increasing the challenge and the fun of the puzzle. Other variations and peg designs may become apparent to those knowledgeable in this art.

Thus, there has been disclosed a novel, manipulative disk puzzle comprised of three component pieces which are identical in construction and design and which interfit to form a geometric shape or block having the appearance of four stacked disks. To make the puzzle interesting and fun to solve, a plurality of manipulative, variably positioned inserts are provided which may be manipulated between various levels of the puzzle in order to open the components and separate the puzzle.

Obviously, many modifications and variations of the invention are now possible in light of the above teachings. It is, therefore, to be understood that the full scope of the invention is not limited to the details disclosed herein, but only by the appended claims and may be practiced otherwise than as specifically described.

What is claimed is:

1. A puzzle comprising:

at least two separate puzzle pieces which are interfittable to form an integral piece having a predetermined configuration;

each of said puzzle pieces including surface markings similar in appearance to the interfitting surfaces of said puzzle pieces to disguise the interrelationship of said puzzle pieces; and at least one slidable insert member which is slidably movable through apertures extending through said puzzle pieces when aligned in the predetermined configuration, said insert member being movable between a plurality of different positions relative to said puzzle pieces, said insert member having at least one position which enables said puzzle pieces to be moved apart from one another and said insert member having a plurality of positions which prevent said puzzle pieces from being moved from the predetermined configuration.

2. The puzzle of claim 1 comprising three separate puzzle pieces interfittable to form the predetermined configuration.

3. The puzzle of claim 2 wherein each of said puzzle pieces is formed in multiple layers of offset sections to provide a layered appearance to the integral piece in the predetermined configuration disguising the adjoining surfaces of said puzzle pieces.

4. The puzzle of claim 1 wherein the corners of any one of said puzzle pieces abutting a surface of another of said puzzle pieces is rounded to reduce difficulty in interfitting said puzzle pieces in the predetermined configuration.

5. The puzzle of claim 1 further comprising means for providing a predetermined resistance to movement of said insert member within said aperture.

6. The puzzle of claim 1 further comprising means for positively engaging said insert member within an aperture to at least one of said puzzle pieces at at least one selected position in said aperture.

7. The puzzle of claim 1 further comprising means for positively restricting said insert member to motion within the aligned apertures in said puzzle pieces.

8. The puzzle of claim 1 wherein said insert member is extendable, said insert member permitting the puzzle pieces to be moved apart from one another only with said insert member in its retracted position.

9. A puzzle comprising:

at least two puzzle pieces, each of said puzzle pieces having multiple offset layers, interfittable to form an integral piece of predetermined shape, each of said puzzle pieces having a plurality of apertures formed therethrough, every aperture in each of said puzzle pieces being aligned with an aperture in at least one other of said puzzle pieces when said puzzle pieces form said predetermined shape; and a plurality of inserts for slidable movement within the apertures, each of said inserts being slidable to at least one position within aligned apertures confined in a single puzzle piece to permit disassembly of the puzzle and at least one position preventing disassembly.

10. The puzzle of claim 9 comprising three substantially identical puzzle pieces.

11. The puzzle of claim 9 wherein each layer of said puzzle pieces extends a predetermined arc about the center of the puzzle in the predetermined shape, each of said layers having radially disposed sidewalls for interfitting said puzzle pieces, the layers in each of said puzzle pieces being offset from adjacent layers radially about the center of the puzzle.

12. The puzzle of claim 11 wherein the edges of each of said puzzle pieces interfitting at the center of the puzzle are rounded to ease assembly of the puzzle.

13. The puzzle of claim 9 wherein the end of each of said apertures opening outside the puzzle in the predetermined shape includes a lip to confine said inserts therein.

14. The puzzle of claim 9 further comprising friction means secured between each of said inserts and apertures to resist movement of said inserts.

15. The puzzle of claim 9 wherein each of said inserts includes a flexible member, said apertures having notches at preselected locations therein for locking engagement with said flexible member to positively secure an insert in a preselected position within an aperture.

16. The puzzle of claim 9 wherein each of said inserts includes a sleeve slidable within said apertures and a plug slidable within said sleeve, and inserts thereby being extendable by moving said plug within said sleeve.

17. The puzzle of claim 9 wherein each of said puzzle pieces include markings similar in appearance to the interfitting surfaces of said puzzle pieces to disguise the interrelationship of said puzzle pieces.

18. A puzzle comprising:

three substantially identical pieces which are interfittable to form a geometric solid having a predetermined configuration, each of said pieces having a plurality of trisected disks which are integrally fastened one beneath another, each tri-section being offset from the tri-section above approximately sixty degrees, each of said pieces having a plurality of apertures which are in alignment with apertures in the other pieces when they are interfitted, a plurality of manipulatible inserts manipulatible between apertures in the interfitted pieces which when properly positioned allow the three interfitted pieces to be separated and when not properly positioned lock the three pieces together.

19. The device according to claim 18 in which each of said pieces have four levels.

20. The device according to claim 18 in which said pieces when interfitted form a geometric solid having a substantially hexagonal shape.

21. The device according to claim 18 in which said tri-sections have a diamond shape.

22. The device according to claim 18 in which said inserts have a depth equal to the thickness of two of said tri-sections.

23. The device according to claim 22 in which said inserts are cylindrical.

24. The device according to claim 24 in which there are six of said inserts.

25. The device according to claim 24 in which said inserts are comprised of;

a sleeve slidable in said apertures;

a plug slidable within said sleeve.

26. The device according to claim 25 including stop means to stop said plug so that said plug and sleeve slide independently until they reach said stop, then slide together.

27. The device according to claim 26 in which said pieces when interfitted form a geometric solid having a substantially cylindrical shape.

28. The device according to claim 19 in which said pieces when interfitted form a geometric solid having a substantially hexogonal shape.

29. The device according to claim 19 in which said tri-sections have a diamond shape.

30. The device according to claim 21 in which said inserts have a depth equal to the thickness of two of said tri-sections.

31. The device according to claim 30 in which said inserts are cylindrical.

32. The device according to claim 31 in which there are six of said inserts.

33. The device according to claim 32 in which said inserts are comprised of;

a sleeve slidable in said apertures;

a plug slidable within said sleeve.

34. The device according to claim 33 including stop means to stop said plug so that said plug and sleeve slide independently until they reach said stop, then slide together.

* * * * *